US009126379B2

(12) United States Patent
Uchiyama et al.

(10) Patent No.: US 9,126,379 B2
(45) Date of Patent: Sep. 8, 2015

(54) SERVO PRESS SYSTEM

(75) Inventors: Shingo Uchiyama, Sagamihara (JP); Osamu Yahata, Sagamihara (JP); Hiroaki Yoshida, Kanazawa (JP); Akira Harada, Kanazawa (JP)

(73) Assignee: AIDA ENGINEERING LTD., Kanagawa (JP)

( * ) Notice: Subject to any disclaimer, the term of this patent is extended or adjusted under 35 U.S.C. 154(b) by 800 days.

(21) Appl. No.: 13/359,948

(22) Filed: Jan. 27, 2012

(65) Prior Publication Data

US 2012/0192607 A1 Aug. 2, 2012

(30) Foreign Application Priority Data

Jan. 28, 2011 (JP) ..... 2011-016312

(51) Int. Cl.

| | |
|---|---|
| ***B30B 15/30*** | (2006.01) |
| ***B30B 15/14*** | (2006.01) |
| ***B21D 43/05*** | (2006.01) |
| ***B30B 1/26*** | (2006.01) |

(52) U.S. Cl.

CPC ..... *B30B 15/148* (2013.01); *B21D 43/05* (2013.01); *B30B 1/266* (2013.01)

(58) Field of Classification Search

CPC ..... B30B 15/148; B30B 1/266; B30B 15/14; B21D 43/05

USPC ..... 100/43, 48, 280, 281, 282, 35; 72/14.8–15.1, 17.1, 17.2, 20.2, 20.3, 72/405.01–505.16, 20.1; 700/97–87, 174, 700/178, 206

See application file for complete search history.

(56) References Cited

U.S. PATENT DOCUMENTS

| | | | | |
|---|---|---|---|---|
| 5,231,860 | A | 8/1993 | Tsuruta et al. | |
| 5,970,763 | A | 10/1999 | Takayama | |
| 6,182,023 | B1 | 1/2001 | Ohtsu et al. | |
| 6,185,517 | B1 | 2/2001 | Ohtsu et al. | |
| 6,742,457 | B2 | 6/2004 | Shiroza | |
| 6,845,646 | B2 * | 1/2005 | Goto | 72/20.1 |
| 7,891,223 | B2 | 2/2011 | Kaneko et al. | |
| 8,096,233 | B2 | 1/2012 | Kaneko | |
| 2003/0004604 | A1 | 1/2003 | Goto | |

(Continued)

FOREIGN PATENT DOCUMENTS

| | | | |
|---|---|---|---|
| EP | 0837379 | A | 4/1998 |
| EP | 1615090 | A1 | 1/2006 |
| EP | 1 815 972 | A2 | 8/2007 |

(Continued)

OTHER PUBLICATIONS

International Search Report for PCT/JP2005/019934 mailed Jan. 24, 2006.

(Continued)

*Primary Examiner* — Jimmy T Nguyen

(74) *Attorney, Agent, or Firm* — McDermott Will & Emery LLP

(57) ABSTRACT

A servo press system in which a servo transfer device implements a transfer operation by utilizing first transfer operation instruction information that is generated depending on a mechanical motion state of a press element of a servo press or second transfer operation instruction information that is generated independently of the mechanical motion state of the press element during a press operation using a pendulum motion.

12 Claims, 7 Drawing Sheets

(56) References Cited

U.S. PATENT DOCUMENTS

| | | | | |
|---|---|---|---|---|
| 2003/0029218 | A1* | 2/2003 | Nakagawa | 72/421 |
| 2008/0295564 | A1* | 12/2008 | Kaneko et al. | 72/405.13 |

FOREIGN PATENT DOCUMENTS

| | | | |
|---|---|---|---|
| JP | 5-71904 | U | 9/1993 |
| JP | 6-55352 | A | 3/1994 |
| JP | 7-1060 | A | 1/1995 |
| JP | 8-96025 | A | 4/1996 |
| JP | 8-304494 | A | 11/1996 |
| JP | 9-237285 | A | 9/1997 |
| JP | 11-245097 | A | 9/1999 |
| JP | 2000-343294 | A | 12/2000 |
| JP | 2001-062591 | A | 3/2001 |
| JP | 2003-19527 | A | 1/2003 |
| JP | 2003-19600 | A | 1/2003 |
| JP | 2003-108212 | A | 4/2003 |
| JP | 2003-181698 | A | 7/2003 |
| JP | 2003-191096 | A | 7/2003 |
| JP | 2003-245800 | A | 9/2003 |
| JP | 2003-260530 | A | 9/2003 |
| JP | 2004-058152 | A | 2/2004 |
| JP | 2004-58152 | A | 2/2004 |
| JP | 2005-021934 | A | 1/2005 |
| JP | 2005-262285 | A | 9/2005 |
| JP | 2005-297010 | A | 10/2005 |
| JP | 2006-130560 | A | 5/2006 |
| WO | 2007/091964 | A2 | 8/2007 |

OTHER PUBLICATIONS

Extended European Search Report issued in European Application No. 12152632.1 dated May 8, 2014.

Notification of Reasons for Refusal Japanese Patent Application No. 2011-016312 dated Feb. 5, 2014 with English translation.

Notification of the First Office Action Chinese Patent Application No. 2012100205356 dated Dec. 1, 2014 with full English translation.

Notification of Reasons for Refusal Japanese Patent Application No. 2011-016312 dated Oct. 1, 2014 with English translation.

* cited by examiner

SERVO PRESS SYSTEM

Japanese Patent Application No. 2011-016312, filed on Jan. 28, 2011, is hereby incorporated by reference in its entirety.

BACKGROUND OF THE INVENTION

The present invention relates to a servo press system that includes a servo press that moves a slide upward and downward by rotating a crank shaft, and a servo transfer device that transfers a workpiece to the servo press.

A press machine may typically be classified as a press that includes a motor and a flywheel that are rotated at a constant rotational speed, or a servo press that moves a slide upward and downward by controlling the rotation of a servomotor. These presses significantly differ in slide motion.

The former is configured so that the rotational speed of the crank shaft is constant (see (B) in FIG. 6), and the slide motion via the crank mechanism is also constant (see (A) in FIG. 6).

The latter is configured so that the slide motion can be set arbitrarily. Specifically, the slide can be displaced at low speed within one cycle, and can be stopped at a given position. It is also possible to cause the crank shaft to make a reciprocating rotation motion (pendulum motion) within an arbitrary angular range. It is obvious from the following comparison that the latter is superior from the viewpoint of diversity of the press operation and an improvement in productivity.

The press operation that utilizes the pendulum motion is implemented by causing the crank shaft to make a reciprocating motion at a rotation angle of 60°, 180°, and 300°, for example (see (A) in FIG. 7). The rotational speed of the crank shaft is illustrated in (B) in FIG. 7. The slide reaches the upper limit position when the rotation angle is 60° or 300°. The upper limit position is lower than the position (top dead center position) when the rotation angle is 0° or 360°. Specifically, since an unnecessary rotational motion (rotation time))(300°-360°-60°) can be omitted, the number of press operations at a rotation angle of 180° (bottom dead center position) can be increased (i.e., the cycle time can be reduced).

It is important to solve practical problems that occur during the operation so that the servo press comes into widespread use. For example, it is difficult to determine the relative relationship between the slide position and the rotation angle of the crank shaft of the servo press. For example, the slide is set at the upper limit position (top dead center position) when the rotation angle is 0°(360°) (see (A) in FIG. 6). However, the servo press is configured so that the slide is set at the upper limit position when the rotation angle is 60° or 300° (see (A) in FIG. 7), and the upper limit position (value) differs from (is lower than) the top dead center position (value) (see (A) in FIG. 6). The servo press is also configured so that the rotation angle is not set at 0° (360°) during the press operation. Moreover, the slide position may be identical at different rotation angles. It is difficult to intuitively understand these issues.

Therefore, the slide motion setting operation, the operation of setting the generation timing of a timing signal or a synchronization signal corresponding to the slide motion, and the die height adjustment operation become troublesome, and the working efficiency decreases. The servo press is more troublesome for a person who is accustomed to another press (e.g., a press having a vertical slide drive mechanism), and an erroneous operation may easily occur.

An improvement that utilizes a virtual rotation angle has been proposed (see JP-A-11-245097 and JP-A-2004-58152, for example). In JP-A-11-245097, one stroke of the slide motion is converted into 360°, and the bottom dead center is set corresponding to a rotation angle of 180°. The timing setting and the like can be changed on the motion curve displayed using the virtual rotation angle. In JP-A-2004-58152, the slide position is converted into a virtual crank angle, and displayed. The virtual rotation angle corresponding to the detected slide position is output to an external device.

It is necessary to increase the press speed in order to further improve the productivity. It is also necessary to reliably prevent interference. Since interference occurs based on the relative positional relationship between the press element (part) and the transfer device-side element (part) during the press operation, it is important to operate the press and the transfer device in synchronization.

When a servo press system utilizes an individual control method, the press and the transfer device are controlled independently. Therefore, it may be difficult to increase the operation speed, and prevent interference. When using a master-slave control method, a signal detected by the press is input to the transfer device so that the transfer device operates in synchronization with the press. When using an integrated control method, the press and the transfer device are operated in synchronization based on an identical signal. Each method is used arbitrarily, and is normally selected based on whether the productivity or prevention of interference is regarded as important.

It is effective to increase the operation speed by utilizing the pendulum motion from the viewpoint of an improvement in productivity, irrespective of the control method. In order to prevent interference, it is desirable to drive the transfer device taking account of the relationship with the actual behavior of the press-side part during operation.

The synchronization signal detection method, the synchronization signal detection position, the detector installation position, the signal generation circuit system, and the like may be implemented in various ways. The structure, the rigidity, the inertia, and the like of the transfer device may differ over a wide range. Therefore, an unexpected state may occur during the actual operation of a servo press system. For example, the synchronized operation of the servo press and the transfer device may temporarily become unstable (i.e., the operation of the servo press may be terminated), or deformation or breakage of the device may occur.

SUMMARY

According to a first aspect of the invention, there is provided a servo press system comprising a servo press that moves a slide upward and downward by rotating a crank shaft, and a servo transfer device that transfers a workpiece to the servo press, the servo press implementing a press operation using a pendulum motion, the servo transfer device receiving first transfer operation instruction information that is generated depending on a mechanical motion state of a press element of the servo press, or second transfer operation instruction information that is generated independently of the mechanical motion state of the press element, the servo press system determining whether or not a current motion state of the press element during the pendulum motion is a motion state within a motion direction inversion region, and the servo transfer device implementing a transfer operation by utilizing the first transfer operation instruction information when it has been determined that the current motion state of the press element is not a motion state within the motion direction inversion region, or by utilizing the second transfer operation instruction information when it has been determined that the current motion state of the press element is a motion state within the motion direction inversion region.

According to a second aspect of the invention, there is provided a servo press system that includes a servo press that moves a slide upward and downward by rotating a crank shaft, and a servo transfer device that transfers a workpiece to the servo press, the servo press being able to implement a press operation using a pendulum motion based on press operation instruction information, the servo press system including:

a first transfer operation instruction information generation section that generates first transfer operation instruction information as transfer operation instruction information output to the servo transfer device depending on a mechanical motion state of a press element;

a second transfer operation instruction information generation section that generates second transfer operation instruction information as the transfer operation instruction information output to the servo transfer device independently of the mechanical motion state of the press element;

an intra-inversion region motion determination section that determines whether or not a current motion state of the press element during the pendulum motion is a motion state within a preset motion direction inversion region; and a transfer operation instruction information switch/output section that outputs the first transfer operation instruction information to the servo transfer device when it has been determined that the current motion state of the press element is not a motion state within the motion direction inversion region, and outputs the second transfer operation instruction information to the servo transfer device when it has been determined that the current motion state of the press element is a motion state within the motion direction inversion region, continuity of a transfer motion of the servo transfer device being ensured regardless of whether or not the current motion state of the press element during the pendulum motion of the crank shaft is a motion state within the motion direction inversion region.

DETAILED DESCRIPTION OF THE EMBODIMENT

The invention may provide a servo press system that can be smoothly operated, ensures high productivity, and reliably prevents interference.

The inventors of the invention found that the above problems are likely to occur during the press operation that utilizes the pendulum motion.

Specifically, when the rotational speed of the crank shaft and the slide motion are constant (see FIG. 6), and the transfer operation instruction signal is always output while updating the transfer operation instruction signal every cycle (0 to 360°), a stable transfer motion (e.g., advance motion) can be implemented at a constant speed. Moreover, the start/stop transfer speed can be controlled smoothly, so that an excessive burden is not imposed on the transfer device.

However, when using a servo press that utilizes the pendulum motion, the press element is temporarily stopped when the rotation direction is inverted, and is almost stopped before and after inversion of the rotation direction. Therefore, smooth operation may be hindered depending on the combination of the synchronization signal detection method, the synchronization signal detection position, the detector installation position, the signal generation circuit system, and the like.

Figure 7:
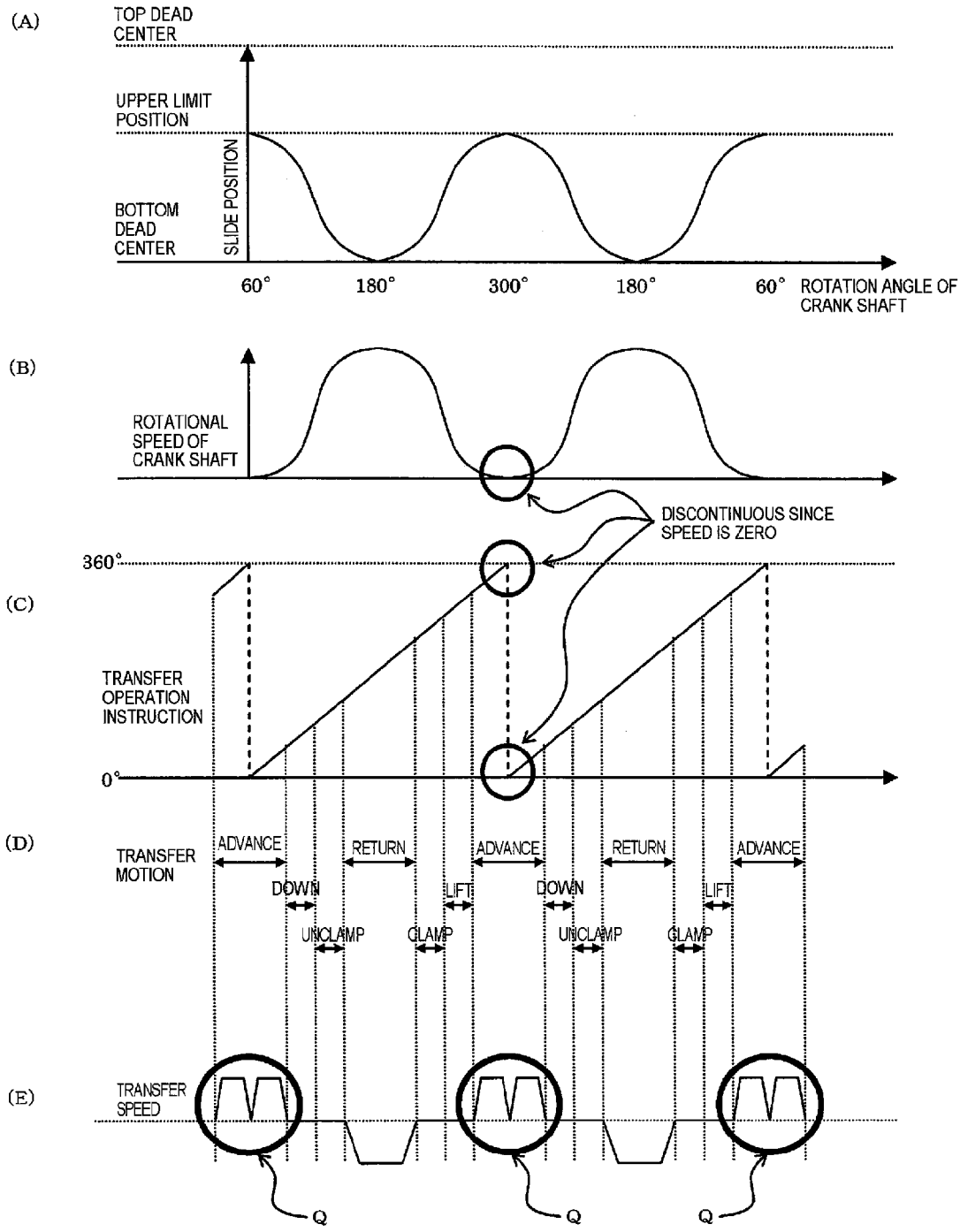
FIG. 7 is a timing chart illustrating a pendulum motion of a servo press and a problem that occurs due to the pendulum motion.

For example, when detecting the synchronization signal using the press element (e.g., slide, servomotor, or crank shaft), determining the actual behavior of such a part, and generating a signal based on the determined behavior (change rate), the crank shaft is necessarily stopped when the rotation direction is inverted (60° or 300°) (see (A) and (B) in FIG. 7). The speed becomes almost zero (0) in the inversion region including the inversion point. The detection area (e.g., servomotor) is stopped when the rotation of the crank shaft is stopped.

Figure 6:
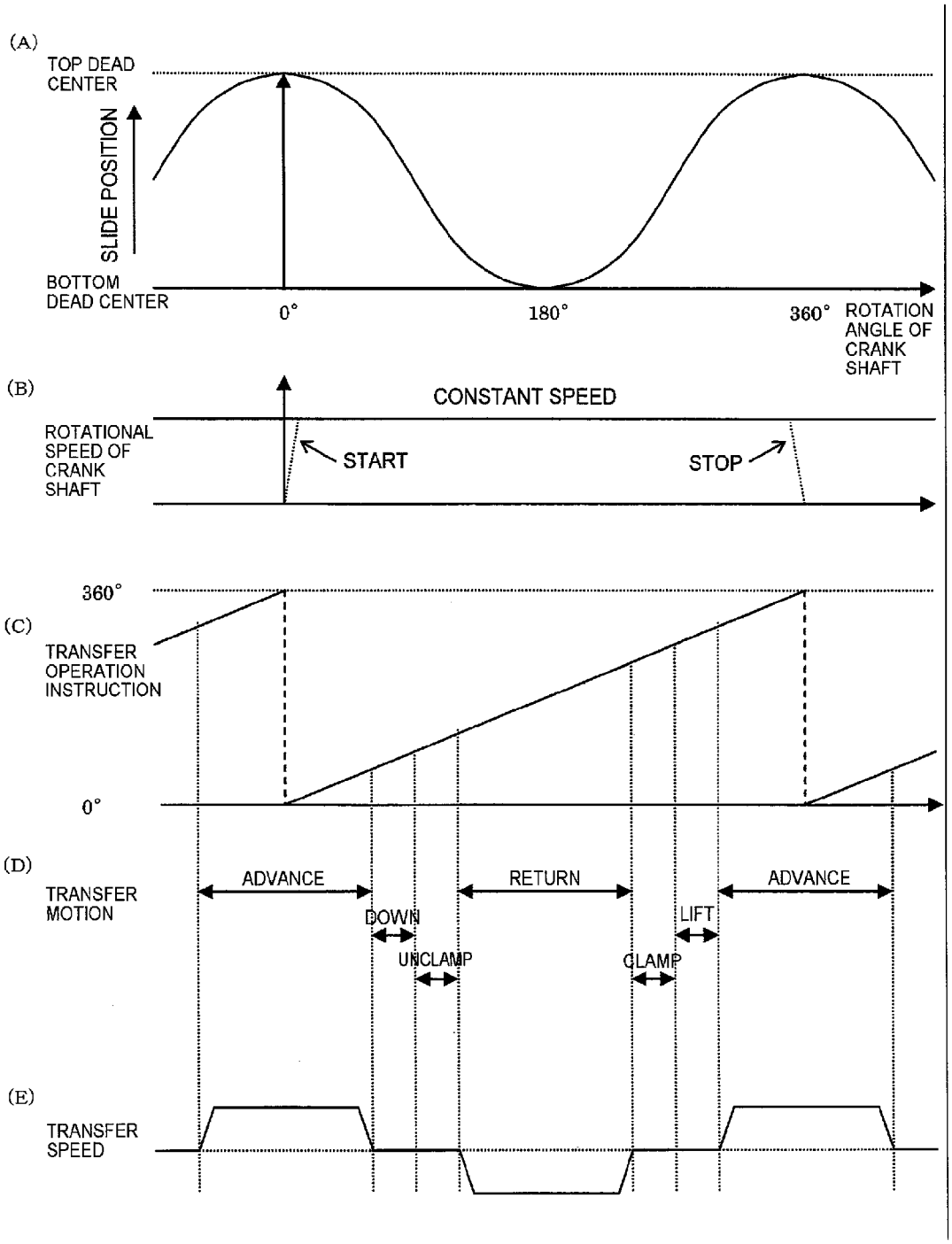
FIG. 6 is a timing chart illustrating a crank motion of a related-art press.

Therefore, when using a method that updates the transfer instruction signal every cycle (see (C) in FIG. 7) (also see (C) in FIG. 6), the detection signal does not change (i.e., the signal is discontinuous) since the detection area is in a stationary state. Therefore, it may be determined that the press operation has been stopped, and a transfer stop instruction has been issued. In this case, the transfer device makes a brake motion (see (E) of FIG. 7) instead of a rapid advance motion (see (D) of FIG. 7). Specifically, the transfer device is temporarily stopped or set in a reset state (Q), so that noise may occur, or the device may be deformed or may break. This also hinders smooth operation, and decreases the productivity.

The invention was conceived in order to ensure that the transfer device can be continuously and smoothly operated when a problem has occurred due to the press operation that utilizes the pendulum motion, while preventing interference (i.e., while causing the transfer device to be synchronized with the actual behavior of the press element). In other words, the invention solves a problem that is likely to occur when utilizing the pendulum motion and causes significant damage during a press operation state (i.e., the slide is located at the upper limit position or the top dead center position) for which it has been considered that interference does not occur.

A servo press system according to one embodiment of the invention includes a servo press that moves a slide upward and downward by rotating a crank shaft, and a servo transfer device that transfers a workpiece to the servo press, the servo press implementing a press operation using a pendulum motion, the servo transfer device receiving first transfer operation instruction information that is generated depending on a mechanical motion state of a press element of the servo press, or second transfer operation instruction information that is generated independently of the mechanical motion state of the press element, the servo press system determining whether or not a current motion state of the press element during the pendulum motion is a motion state within a motion direction inversion region, and the servo transfer device implementing a transfer operation by utilizing the first transfer operation instruction information when it has been determined that the current motion state of the press element is not a motion state within the motion direction inversion region, or by utilizing the second transfer operation instruction information when it has been determined that the current motion state of the press element is a motion state within the motion direction inversion region.

It is thus possible to provide a servo press system that can be smoothly operated, ensures high productivity, and reliably prevents interference.

A servo press system according to another embodiment of the invention includes a servo press that moves a slide upward and downward by rotating a crank shaft, and a servo transfer device that transfers a workpiece to the servo press, the servo press implementing a press operation using a pendulum motion based on press operation instruction information, the servo press system further including:

a first transfer operation instruction information generation section that generates first transfer operation instruction information depending on a mechanical motion state of a press element;

a second transfer operation instruction information generation section that generates second transfer operation instruction information independently of the mechanical motion state of the press element;

an intra-inversion region motion determination section that determines whether or not a current motion state of the press element during the pendulum motion is a state of a motion occurred within a preset motion direction inversion region; and a transfer operation instruction information switch/output section that outputs the first transfer operation instruction information to the servo transfer device when it has been determined that the current motion state of the press element is not a state of a motion occurred within the motion direction inversion region, or outputs the second transfer operation instruction information to the servo transfer device when it has been determined that the current motion state of the press element is a state of a motion occurred within the motion direction inversion region, continuity of a transfer motion of the servo transfer device being ensured regardless of whether or not the current motion state of the press element during the pendulum motion of the crank shaft is a state of a motion occurred within the motion direction inversion region.

It is thus possible to provide a servo press system that can be smoothly operated, ensures high productivity, and reliably prevents interference. Moreover, the servo press system can be easily implemented, and ensures easy handling.

In the servo press system, the first transfer operation instruction information generation section may generate current rotation angle information that depends on a current rotation angle of the crank shaft as the first transfer operation instruction information, the current rotation angle of the crank shaft representing the mechanical motion state of the press element, and the second transfer operation instruction information generation section may generate created rotation angle information that is created based on press speed information and has continuity as the second transfer operation instruction information.

This makes it possible to improve the reliability of the first transfer operation instruction information and the second transfer operation instruction information, and further stabilize the synchronized operation of the servo transfer device and the servo press.

In the servo press system, the current rotation angle information may be converted into a first virtual rotation angle, the created rotation angle information may be converted into a second virtual rotation angle, and the transfer operation instruction information switch/output section may selectively output the first virtual rotation angle or the second virtual rotation angle.

This makes it possible to improve the safety and the reliability of the setting operation, so that handling can be further facilitated while preventing an erroneous operation.

In the servo press system, the first transfer operation instruction information generation section may generate current slide position information that depends on a current position of the slide as the first transfer operation instruction information, the current position of the slide representing the mechanical motion state of the press element, and the second transfer operation instruction information generation section may generate created rotation angle information that is created based on press speed information and has continuity as the second transfer operation instruction information.

This makes it possible to improve the reliability of the first transfer operation instruction information and the second transfer operation instruction information, and further stabilize the synchronized operation of the servo transfer device and the servo press.

The servo press system may further include a switch smoothing section that generates smoothed transfer operation instruction information by combining the first transfer operation instruction information and the second transfer operation instruction information while changing a ratio of the first transfer operation instruction information to the second transfer operation instruction information during a switch operation between the first transfer operation instruction information and the second transfer operation instruction information, and the transfer operation instruction information switch/output section may output the smoothed transfer operation instruction information generated by the switch smoothing section to the servo transfer device during the switch operation.

This makes it possible to implement an even smoother workpiece transfer operation.

Exemplary embodiments of the invention are described in detail below with reference to the drawings.

First Embodiment

Figure 1:
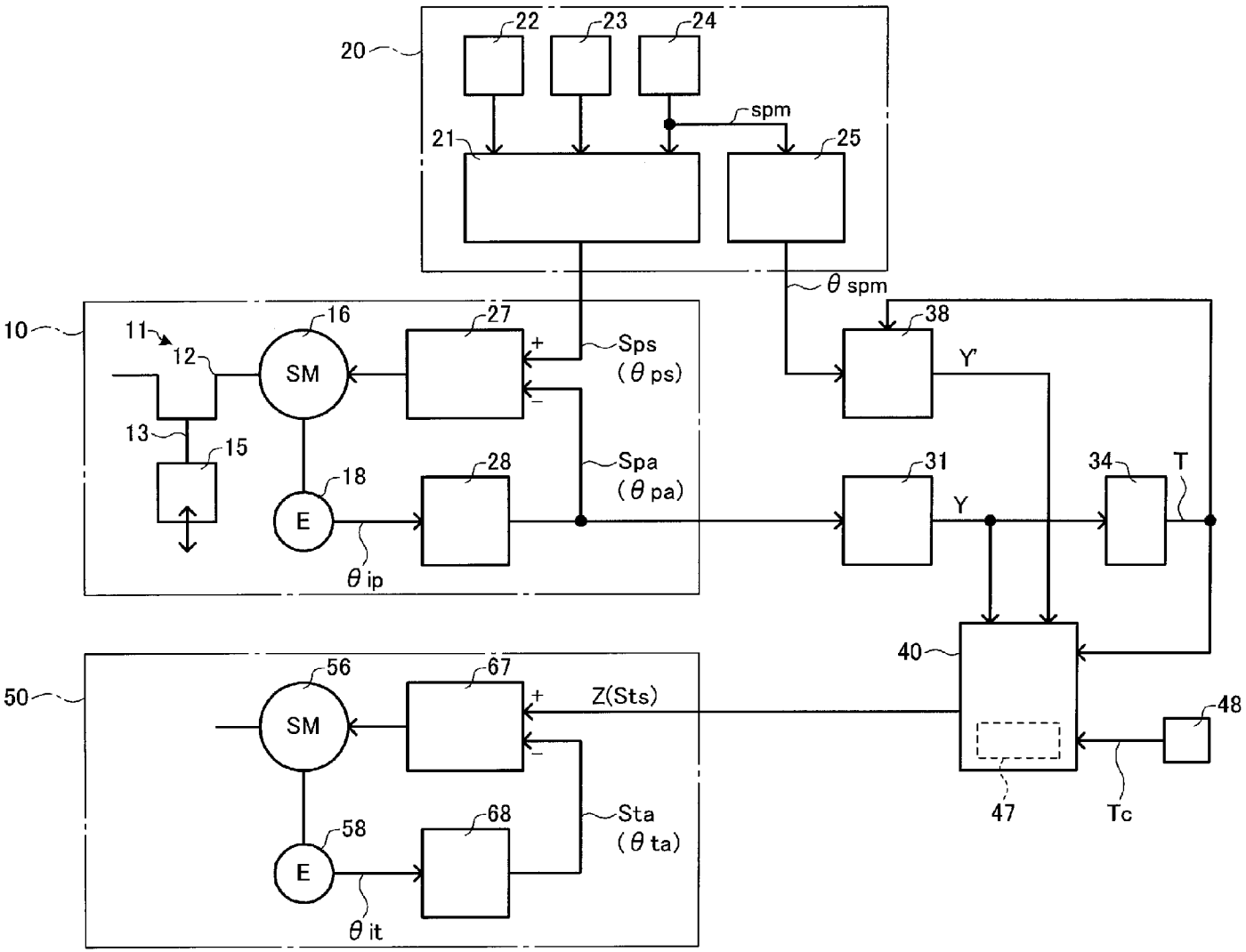
FIG. 1 is a block diagram illustrating a servo press system according to one embodiment of the invention.
Figure 2:
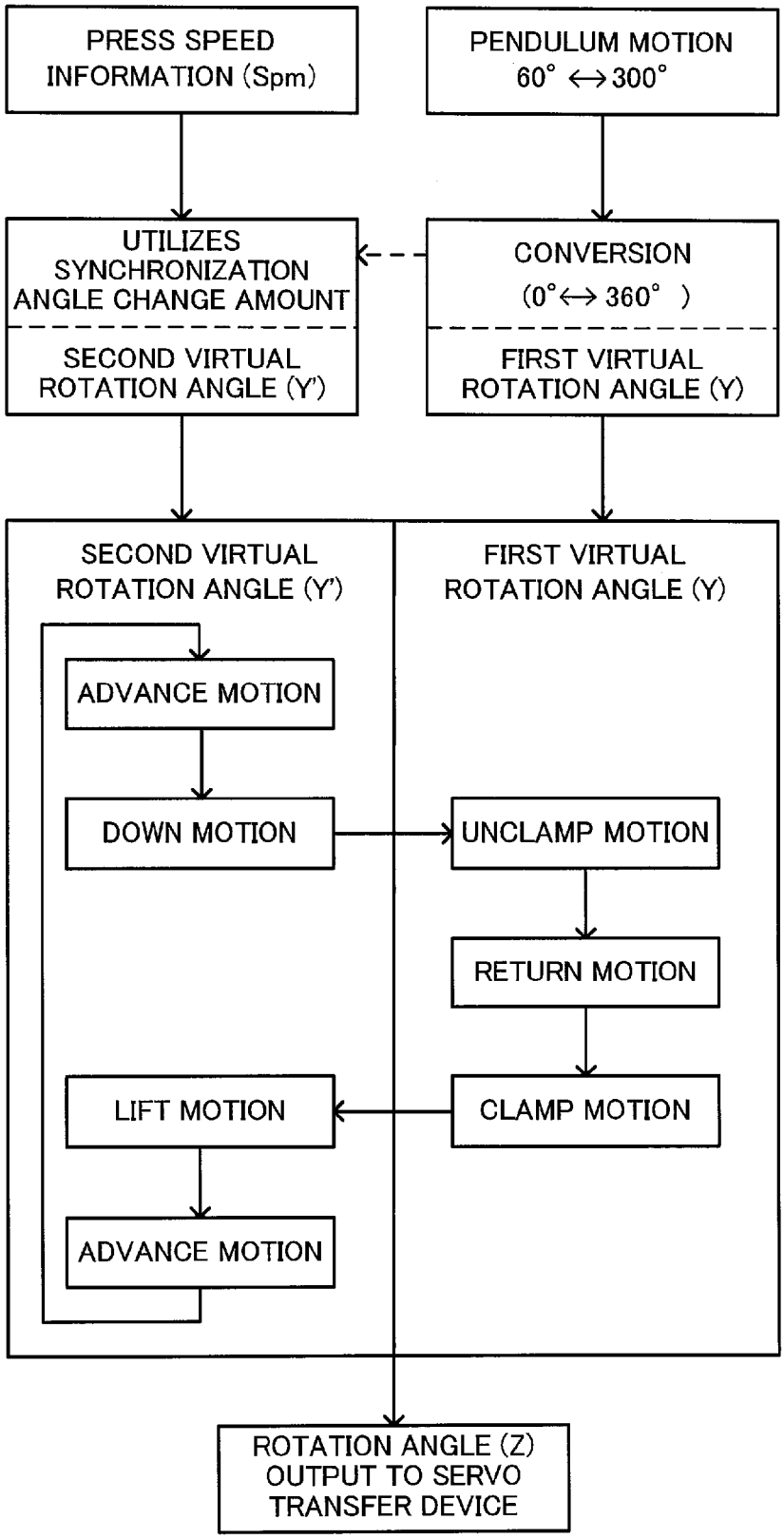
FIG. 2 is a diagram illustrating the relationship between a pendulum motion and a virtual rotation angle.
Figure 3:
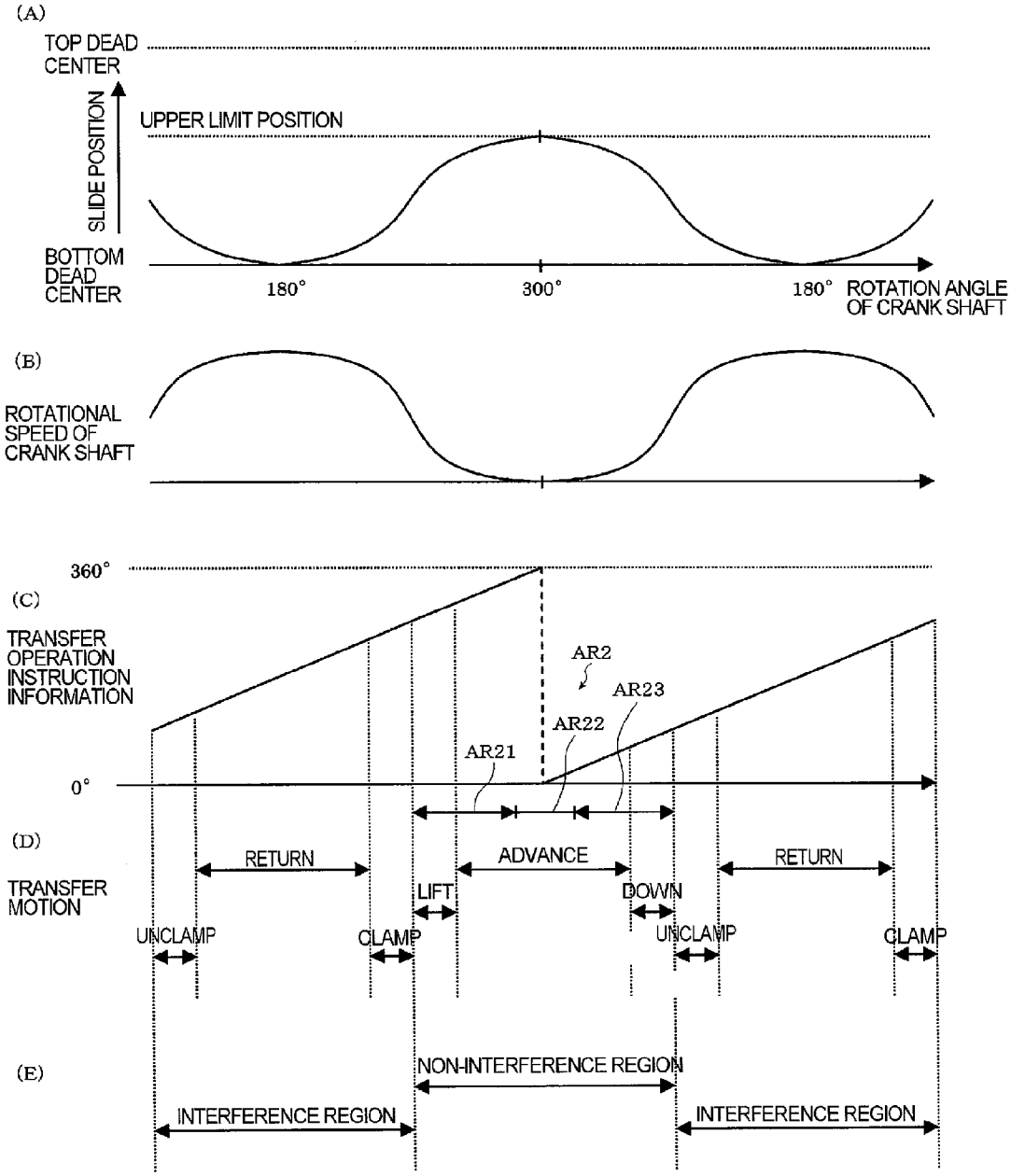
FIG. 3 is a timing chart illustrating the rotational speed of a crank shaft and the like during a pendulum motion.

A servo press system according to a first embodiment of the invention illustrated in FIGS. 1 to 3 is configured to perform a press operation using a pendulum motion based on press operation instruction information (Sprs), and includes a first transfer operation instruction information generation section (current press motion state detector 28), a second transfer operation instruction information generation section 25, a motion direction inversion region determination section (virtual rotation time calculation section 34), and a transfer operation instruction information switch/output section 40, the servo press system being configured so that the continuity of the transfer motion of a servo transfer device 50 is ensured regardless of whether or not the current motion state (θpa) of the press element (e.g., servomotor 16) during the pendulum motion of the crank shaft 12 is a motion state within a motion direction inversion region (non-interference region AR2).

Each section (e.g., 31, 34, and 38) is provided so that the crank angle that specifies the pendulum motion is converted into a virtual rotation angle. This facilitates handling.

As illustrated in FIG. 1, a servo press 10 rotates a crank shaft 12 by controlling the rotation of the servomotor 16 so that a slide 15 is moved upward and downward.

The crank shaft 12 forms a crank mechanism 11 together with a connecting rod 13. When the crank shaft 12 is rotated a full revolution in one direction, the slide position is moved downward from the top dead center position (0°) to the bottom dead center position (180°), and is then moved upward to the top dead center position)(360°=0°. When rotating the crank shaft 12 at a constant rotational speed, the slide motion draws a sine-wave curve (see (A) in FIG. 6).

An encoder 18 is connected to the rotary shaft of the servomotor 16. The encoder outputs an angle-equivalent signal θip by a photoelectric method that utilizes an optical grating. The encoder outputs a given number of pulses (e.g., 1,000,000 pulses) per revolution.

The current press motion state detector (rotation angle detector) 28 receives the angle-equivalent signal θip from the encoder 18, and generates and outputs a rotation angle (crank angle) signal θpa. The rotation angle signal θpa that indicates the current press motion state (current motion state) is input to a press controller 27 as a feedback signal Spa.

A press control section 20 sets, stores, controls, and monitors parameters (e.g., spm and pendulum angle) necessary for the press operation, and controls the entire servo press. A press operation instruction section 21 creates a slide motion corresponding to the motion (e.g., normal motion, pendulum motion, or pause motion) selected by a motion selector 22, the pendulum angle (e.g., 60° or 300°) set by a pendulum angle setter 23, and the press speed (strokes per minute (spm)) set using an spm setter 24, and outputs press operation instruction information Sps based on the created slide motion to the press controller 27. The press operation is thus implemented.

The press operation instruction information Sps indicates a target value. The press operation instruction information Sps is generally and conceptually selected and formed as a position signal, an angle signal, or a speed signal, and generated and output as a pulse signal. In the first embodiment, the press operation instruction information Sps that controls the rotation angle of the crank shaft 12 is output as rotation angle instruction information θps. The press controller 27 compares the target value (Sps=θps) with the feedback signal Spa (current rotation angle information θpa). Specifically, a closed loop angle control system is formed.

The press operation can be implemented using the preset pendulum motion (i.e., the crank shaft 12 is reciprocated (rotated and displaced) between two pendulum angles 60° and 300°) (see (A) and (B) in FIG. 3 ((A) and (B) in FIG. 7)) by thus selecting the pendulum motion, and setting the motion (rotation) direction inversion angle (i.e., pendulum angle) (e.g., 60° and 300°). The two preset pendulum angles need not necessarily be equal (e.g., 120°) around the bottom dead center (180°). The press speed is determined based on the preset spm value.

A speed reducer may be provided between the crank shaft 12 and the servomotor (rotary shaft) 16 and between the servomotor (rotary shaft) 16 and the encoder 18. In this case, it is necessary to perform a reduction gear ratio conversion process.

The servo transfer device 50 transfers a workpiece (material) to the servo press 10, and transfers the workpiece (semi-finished product or finished product) subjected to the press operation to the subsequent stage (subsequent servo press or stock yard). In the first embodiment, the servo transfer device 50 is a three-dimensional transfer device that can perform a clamp motion (workpiece holding motion), a lift motion, an advance motion (advance motion in the workpiece transfer direction), a down motion, an unclamp motion, and a return motion (return motion in the direction opposite to the workpiece transfer direction) (see (D) in FIG. 3) in accordance with a given sequence. Note that the servo transfer device 50 may be a two-dimensional transfer device.

FIG. 1 illustrates only the advance motion and the return motion when using the three-dimensional transfer method. The servomotor 56 rotates an advance/return motion drive shaft (feeder shaft) (not illustrated in FIG. 1). The encoder 18 is connected to the rotary shaft of the servomotor 16. The encoder 58 outputs an angle-equivalent signal θit by a photoelectric method that utilizes an optical grating. The encoder 58 outputs a given number of pulses per revolution.

A current transfer motion state detector (rotation angle detector) 68 receives the angle-equivalent signal θit from the encoder 58, and outputs a rotation angle signal θta that corresponds to the rotation angle of the feeder shaft. The rotation angle signal θta that indicates the current transfer motion state (current motion state) is input to the transfer controller 67 as a feedback signal Sta.

Transfer operation instruction information Z (i.e., target value Sts) is input to the transfer controller 67. The transfer operation instruction information Z is a transfer operation instruction signal that causes the transfer operation (advance motion and return motion) to be performed in synchronization with the press operation (slide upward/downward motion), and is important for avoiding collision (interference) between the press element (part) and the transfer device-side element (part).

Since interference occurs due to the relative mechanical positions of the press element (part) and the transfer device-side element (part), it is preferable to generate the transfer operation instruction information Z from information that corresponds to the actual motion state of the press element (part) during the press operation. Specifically, the transfer operation instruction information Z is generated based on the behavior of the press element (e.g., slide 15, crank shaft 12, and servomotor 16) or part thereof (i.e., the mechanical motion state of the servo press 10).

In the first embodiment, the output from the encoder 18 connected to the servomotor 16 is used as the transfer operation instruction information Z from the viewpoint of the technical characteristics (response and stability) taking account of the accuracy and the economic situation. More specifically, the rotation angle signal θpa that is generated (processed) by the current press motion state detector (rotation angle detector) 28 and indicates the rotation angle (current motion state) of the crank shaft 12 is used as the transfer operation instruction information Z.

The transfer operation can be controlled even if the transfer operation instruction information Z (rotation angle signal θpa) is input directly to the transfer controller 67. In this case, however, a problem may occur due to a special situation (i.e., a pause state that occurs when the crank shaft 12 is inverted) when the press operation is performed using the pendulum motion.

Specifically, the crank shaft 12 necessarily becomes stationary until the motion (rotation) direction is completely inverted. The transfer operation instruction information Z (rotation angle signal θpa) is generated based on the mechanical motion state (change in rotation angle) of the press element (e.g., crank shaft 12). Therefore, the rotation angle signal θpa become discontinuous when the motion direction of the crank shaft 12 is inverted (see (B) and (C) in FIG. 7).

Specifically, the signal disappears, or the press operation stops. That is, the servomotor 56 cannot be rotated as illustrated in (B) in FIG. 3 (i.e., enters a stationary state).

The slide 15 is located at the upper limit position when the motion direction of the crank shaft 12 is inverted (see (A) in FIG. 3). In this case, interference does not occur. Therefore, the advance motion is configured to be a continuous transfer motion at the maximum speed. If the motor is rapidly stopped (braked) due to the discontinuous rotation angle signal θpa, an excessive impact is applied to each part due to the large mechanical inertia of the transfer (advance-return) device 50. Therefore, each element or part thereof may be deformed or may break. Moreover, large noise may occur, or the productivity may significantly deteriorate. The above problems occur more easily and significantly as the transfer speed increases.

The above problems easily occur when the current press motion state detector (rotation angle detector) 28, the transfer controller 67, and the like utilize a signal processing method that regards the signal change rate as important, or the oscillation frequency of the rotation angle signal θpa or the angular resolution per pulse signal increases. The above problems may or may not occur depending on the performance/characteristics of each section and a combination thereof. Therefore, it is very risky to attempt to solve a problem after the system/device has been constructed or operated. Specifically, it is necessary to take careful countermeasures in advance.

The servo press system according to the first embodiment includes each section (28, 25, 34, 40) that solves the above problems, and is configured so that the continuity of the transfer motion of the servo transfer device 50 is ensured.

The first transfer operation instruction information generation section generates the transfer operation instruction information (first transfer operation instruction information) output to the servo transfer device 50 depending on the mechanical motion state of the press element. The expression "generates information depending on the mechanical motion state of the press element" refers to determining the mechanical motion state among the electrical and mechanical motions of the press element due to the progress of the actual operation of the servo press 10, and generating information corresponding to the determined mechanical motion state. This aims at improving the synchronization performance of the transfer operation based on the actual press operation.

In the first embodiment, the first transfer operation instruction information generation section includes the current press motion state detector (rotation angle detector) 28, and the first transfer operation instruction information (current rotation angle information θpa) is generated depending on the current rotation angle θip of the crank shaft 12 that is in a mechanical motion state.

A first virtual rotation angle generation section 31 converts the first transfer operation instruction information (current rotation angle information θpa) into a first virtual rotation angle Y (see FIGS. 1, 2, 4, and 5). The first virtual rotation angle generation section 31 reads right and left pendulum motion angles θr and θl (e.g., 60° and 300°) that are set and stored by the press control section 20, calculates the pendulum range θlr (=θl−θr=240°), and calculates the first virtual rotation angle Y. The first virtual rotation angle generation section 31 calculates the first virtual rotation angle Y using the expression "Y=360°−(300°−X)×(360°/θlr)". X is an arbitrary angle within the range from 60° to 300°.

When X=60, 90, 120, 150, 210, 240, or 270°, Y=0, 45, 90, 135, 225, 270, or 315°. Y=180° when X=180°.

The second transfer operation instruction information generation section generates the transfer operation instruction information (second transfer operation instruction information) output to the servo transfer device 50 independently of the mechanical motion state of the press element. The second transfer operation instruction information generation section may generate the second transfer operation instruction information depending on the electrical motion state of the press element, or may generate the second transfer operation instruction information y utilizing a signal output from a signal generator, as long as the information (signal) has continuity.

In the first embodiment, the second transfer operation instruction information generation section 25 can generate and output created rotation angle information (second transfer operation instruction information) θspm that is created based on preset press speed information (spm). The created rotation angle information (second transfer operation instruction information) θspm is a signal that has continuity.

For example, when the preset press speed is 30 spm, and the output time of the control circuit (second transfer operation instruction information generation section 25) is 1 ms, the output count per revolution of the crank shaft 12 is 2000. Therefore, the created rotation angle information θspm that corresponds to 0.18° per output is continuously generated and output. Specifically, the synchronization angle change amount per output is 0.18°.

Figure 4:
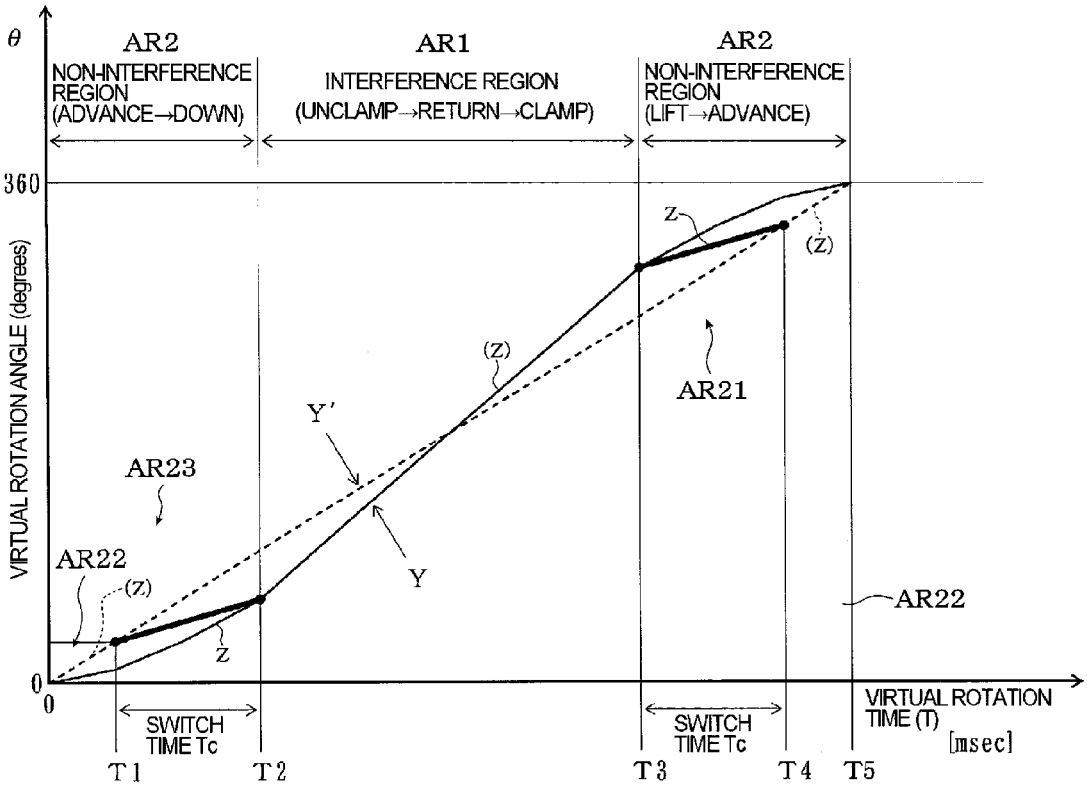
FIG. 4 is a timing chart illustrating a switch operation between first transfer operation instruction information and second transfer operation instruction information.

Specifically, the created rotation angle information θspm that is continuous even when the motion direction of the crank shaft 12 is inverted (the crank shaft 12 is stationary) can be reliably generated by outputting a plurality of pulse signals that subdivide the synchronization angle change amount (0.18°) in the output period (T=0 to T5 in FIG. 4). The rotation angle (resolution) per pulse of the created rotation angle information θspm is determined to be consistent with the resolution of the rotation angle signal θpa that can be output taking account of the performance of the encoder 18 and the current press motion state detector (rotation angle detector) 28. The rotation angle is 0.05°, for example.

A second virtual rotation angle generation section 38 converts the second transfer operation instruction information (created rotation angle information θspm) into a second virtual rotation angle Y' (see FIGS. 1, 2, 4, and 5). The second virtual rotation angle Y' is reset and generated again each time the virtual rotation time T output from a virtual rotation time calculation section 34 (see FIG. 1) becomes zero (0). Specifically, the second virtual rotation angle Y' is updated every cycle (e.g., 300°) (see the dotted line in FIG. 4).

In FIG. 4, the second virtual rotation angle Y' is successively (continuously) output at constant pulse intervals from 0° to 360° (virtual rotation angle) when the virtual rotation time T (horizontal axis) is 0 to T5. The first virtual rotation angle Y that is generated depending on the pendulum motion is indicated by a solid straight line within the interference region AR1, and is curved within the non-interference region AR2. In FIG. 4 that mainly illustrates the smoothing function, the first virtual rotation angle Y seems to be also output during (around) inversion (T=0 or T5). Note that the first virtual rotation angle Y is discontinuous within a motion direction inversion region AR22 at a point near the inversion point (output stop state).

In the first embodiment, the virtual rotation time calculation section 34 also functions as an intra-inversion region motion determination section (non-interference region determination section). Note that each reference symbol in FIGS. 3 and 4 has the following meaning.

Reference symbol AR1 indicates the interference region (unclamp motion→return motion→clamp motion). The interference region refers to a region in which interference between the press element and the transfer device element is likely to occur. Reference symbol AR2 indicates the non-interference region (lift motion→advance motion→down motion). The non-interference region refers to a region in which interference between the press element and the transfer device element does not occur.

The non-interference region AR2 is a motion direction inversion region, and is subdivided (AR21, AR22, and AR23). The motion direction inversion region AR22 is a low-speed motion region of the crank shaft 12 (slide 15) around the inversion point (60° or 300°). Reference symbol AR21 indicates a forward smoothing region, and reference symbol AR23 indicates a backward smoothing region.

In FIG. 4, the horizontal axis indicates the virtual rotation time (T), and the vertical axis indicates the virtual rotation angle (degrees). Therefore, the forward smoothing region AR21 and the backward smoothing region AR23 are opposite to those illustrated in (A) and (C) in FIG. 3.

The intra-inversion region motion determination section (virtual rotation time calculation section 34) determines whether or not the current motion state (current press motion state) of the press element (crank shaft 12) during the pendulum motion is a motion state within the preset motion direction inversion region (non-interference region AR2) based on the virtual rotation time T calculated by the virtual rotation time calculation section 34 (time management determination method). In FIG. 4, the intra-inversion region motion determination section (virtual rotation time calculation section 34) determines that the current motion state (current press motion state) of the press element (crank shaft 12) during the pendulum motion is a motion state within the motion direction inversion region (non-interference region AR2) when the virtual rotation time (T) is 0 to T2 or T3 to T5 (=0).

The transfer operation instruction information switch/output section 40 outputs the first transfer operation instruction information (Y=Z) to the servo transfer device 50 (transfer controller 67) when the intra-inversion region motion determination section (virtual rotation time calculation section 34) has determined that the current motion state θpa) of the press element (crank shaft 12) is not a motion state within the preset motion direction inversion region (non-interference region AR2).

Figure 5:
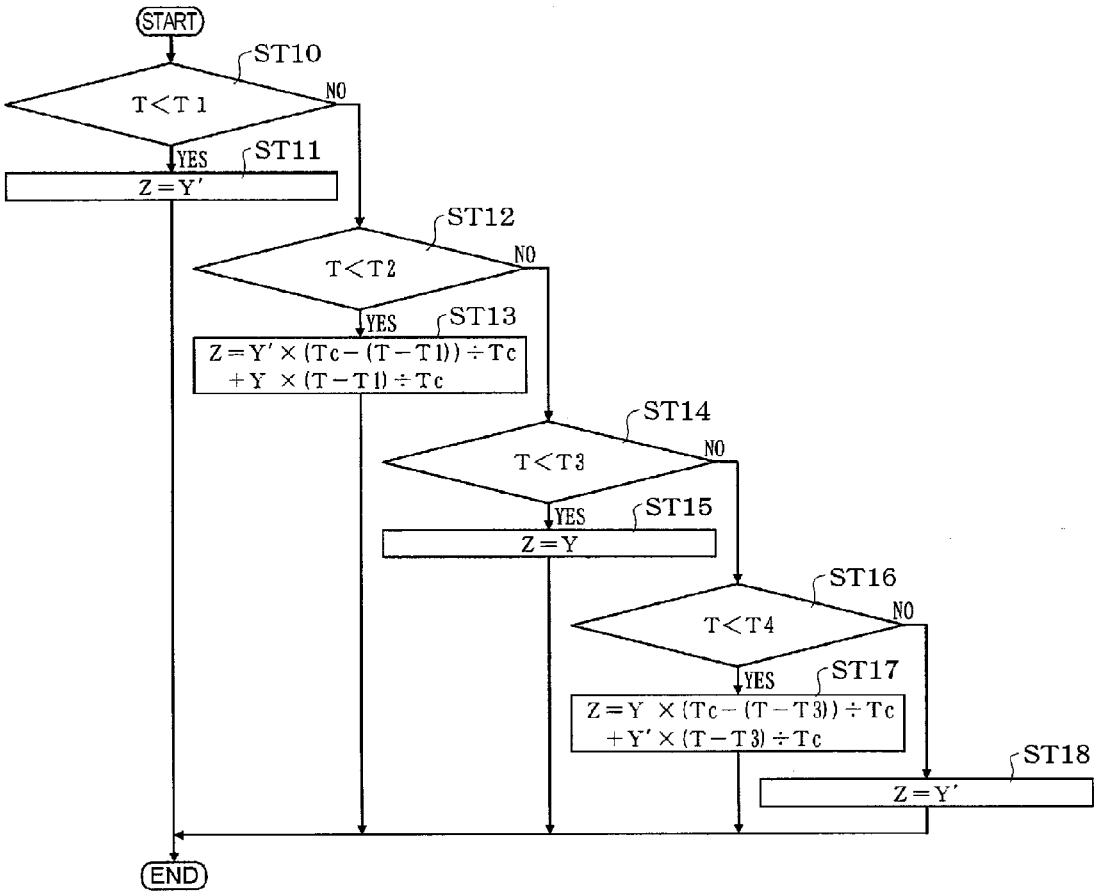
FIG. 5 is a flowchart illustrating a switch operation between first transfer operation instruction information and second transfer operation instruction information.

Specifically, the transfer operation instruction information switch/output section 40 outputs the first virtual rotation angle Y (=Z) indicated by the solid line in FIG. 4 to the transfer controller 67 when the intra-inversion region motion determination section (virtual rotation time calculation section 34) has determined that the current motion state (θpa) of the press element (crank shaft 12) is not a motion state within the preset motion direction inversion region (non-interference region AR2) (i.e., is not a motion state within the interference region AR1) based on the virtual rotation time T calculated from the first virtual rotation angle Y that corresponds to the current motion state (θpa) (ST15 in FIG. 5).

The transfer operation instruction information switch/output section 40 outputs the second transfer operation instruction information (Y'=Z) to the servo transfer device 50 (transfer controller 67) when the intra-inversion region motion determination section (virtual rotation time calculation section 34) has determined that the current motion state (θpa) of the press element (crank shaft 12) is a motion state within the preset motion direction inversion region (non-interference region AR2).

Specifically, the transfer operation instruction information switch/output section 40 outputs the second virtual rotation angle Y' (=Z) indicated by the dotted line in FIG. 4 to the transfer controller 67 when the intra-inversion region motion determination section (virtual rotation time calculation section 34) has determined that the current motion state (θpa) of the press element (crank shaft 12) is a motion state within the preset motion direction inversion region (non-interference region AR2) based on the virtual rotation time T calculated from the first virtual rotation angle Y (ST11 and ST18 in FIG. 5).

It suffices to switch the virtual rotation angle from the first virtual rotation angle Y that depends on the mechanical motion state of the press element to the second virtual rotation angle Y' that has continuity only within the motion direction inversion region AR22 (see (C) and (D) in FIG. 3). However, the difference in angle-equivalent signal between the first virtual rotation angle Y and the second virtual rotation angle Y' is not necessarily small when the virtual rotation angle is switched from the first virtual rotation angle Y to the second virtual rotation angle Y' (T3 or T4 in FIG. 4) and when the virtual rotation angle is switched from the second virtual rotation angle Y' to the first virtual rotation angle Y (T1 or T2 in FIG. 4).

Specifically, a relatively electrical/mechanical shock may occur depending on the configuration and the operation state of the servo press 10 and the servo transfer device 50, and the like, if the switch output control process is performed using only the time management method employed for the transfer operation instruction information switch/output section 40. Moreover, smooth operation may be interrupted.

Therefore, the transfer operation instruction information switch/output section (virtual rotation angle switch/output section) 40 is configured to output smoothed transfer operation instruction information (Z) generated by a switch smoothing section 47 during the switch operation.

The switch smoothing section 47 generates and outputs the smoothed transfer operation instruction information Z indicated by the bold solid line in FIG. 4 while changing the ratio of the first transfer operation instruction information (first virtual rotation angle Y) to the second transfer operation instruction information (second virtual rotation angle Y') during the switch operation between the first transfer operation instruction information and the second transfer operation instruction information (ST13 and ST17 in FIG. 5).

In FIGS. 4 and 5, when the virtual rotation time T is less than T1 (YES in ST10), the second virtual rotation angle Y' (=Z) indicated by the dotted line is output (ST11). Therefore, even if the servomotor 56 may be stopped since the first virtual rotation angle Y is or close to zero (0) at the motion direction inversion point (T=0 in FIG. 4) or within the nearest low-speed motion region, no problem occurs since the virtual rotation angle has been switched to the second virtual rotation angle Y' (=Z).

When the virtual rotation time T is equal to or larger than T4 (and T=T5) (NO in ST16), no problem occurs since the second virtual rotation angle Y' (=Z) indicated by the dotted line is output (ST18).

When the virtual rotation time T is larger than T2 and less than T3 (YES in ST14) (i.e., interference region AR1), the first virtual rotation angle Y is output (ST15).

When the virtual rotation time T is larger than T1 and less than T2 (YES in ST12), the virtual rotation angle Z indicated by the bold solid line that is a combination of the second virtual rotation angle Y' component that gradually decreases with the lapse of the virtual rotation time T and the first virtual rotation angle Y component that gradually increases with the lapse of the virtual rotation time T is output (ST13). When the virtual rotation time T is larger than T3 and less than T4 (YES in ST16), the virtual rotation angle Z indicated by the bold solid line that is a combination of the first virtual rotation angle Y component that gradually decreases with the lapse of the virtual rotation time T and the second virtual rotation angle Y' component that gradually increases with the lapse of the virtual rotation time T is output (ST17).

The switch time Tc is changed using a smoothing time setting section 48 (see FIG. 1). Specifically, the range of the motion direction inversion region AR22 and the forward and backward smoothing regions AR21 and AR23 in which the transfer operation should be performed using the second virtual rotation angle Y' that has continuity can be optimized for the system and the pendulum motion operation.

According to the first embodiment, the servo press system includes the servo press 10 that implements the press operation using the pendulum motion, and the servo transfer device 50, and is configured so that the transfer operation instruction information includes the first transfer operation instruction information (θpa) that is generated depending on the mechanical motion state of the press element (e.g., servomotor 16), and the second transfer operation instruction information (θspm) that is generated independently of the mechanical motion state of the press element (e.g., servomotor 16), and the transfer operation of the servo transfer device 50 is implemented using the first transfer operation instruction information Y when the current motion state of the press element is not a motion state within the motion direction inversion region, and is implemented using the second transfer operation instruction information Y' when the current motion state of the press element is a motion state within the motion direction inversion region. This makes it possible to provide a servo press system that can be smoothly operated, ensures high productivity, and reliably prevents interference.

The servo press system includes the first transfer operation instruction information generation section (current press motion state detector 28), the second transfer operation instruction information generation section 25, the intra-inversion region motion determination section (virtual rotation time calculation section 34), and the transfer operation instruction information switch/output section 40, and is configured so that the continuity of the transfer motion of the servo transfer device 50 is ensured regardless of whether or not the current motion state of the press element during the pendulum motion of the crank shaft 12 is a motion state within the motion direction inversion region. Therefore, the servo press system can be easily implemented, and ensures easy handling.

Since the first transfer operation instruction information generation section (current press motion state detector 28) can generate the current rotation angle information θpa as the first transfer operation instruction information Y, and the second transfer operation instruction information generation section 25 can generate the created rotation angle information θspm that is created based on the press speed information spm and has continuity as the second transfer operation instruction information Y', the reliability of the first transfer operation instruction information and the second transfer operation instruction information can be improved, and the synchronized operation of the servo transfer device 50 and the servo press 10 can be further stabilized.

Since the transfer operation instruction information switch/output section 40 can selectively output the first virtual rotation angle Y obtained by converting the current rotation angle information θpa or the second virtual rotation angle Y' obtained by converting the created rotation angle information θspm, the safety and the reliability of the setting operation can be improved, so that handling can be further facilitated while preventing an erroneous operation.

Since the transfer operation instruction information switch/output section 40 can output the smoothed transfer operation instruction information Z generated by the switch smoothing section 47 during the switch operation, a further smooth workpiece transfer operation can be implemented.

Since the switch time Tc can be changed using the smoothing time setting section 48, the adaptability of the configuration and the operation can be improved while further facilitating handling.

Second Embodiment

A second embodiment is the same as the first embodiment as to the basic configuration and function (FIGS. 1 to 5), but differs from the first embodiment as to the information (signal) handled by the first transfer operation instruction information generation section.

Specifically, the press controller 27 forms a closed loop position control system that adjusts the slide position by controlling the servomotor 16 using press operation instruction information Sps (slide position instruction information Pps) and slide position instruction information Ppa as the target value and the feedback signal, respectively. The first transfer operation instruction information (Sts) basically includes the slide position instruction information Ppa.

Specifically, the press operation instruction section 21 is configured to output the slide position instruction information Pps, differing from the first embodiment (rotation angle instruction information θps). The current press motion state detector 28 is formed as a slide position detector, differing from the first embodiment (rotation angle detector). The current press motion state detector 28 generates and outputs the current slide position information Ppa.

Specifically, the first transfer operation instruction information generation section includes the current press motion state detector (slide position detector) 28, and performs a given process on the current rotation angle θip input from the encoder 18 to generate the current slide position information Ppa that corresponds to the current rotation angle θip, and outputs the current slide position information Ppa. Specifically, the first transfer operation instruction information generation section (current press motion state detector 28) is configured to generate the current slide position information Ppa that depends on the current position Pi (detected as the rotation angle θip corresponding thereto) of the slide 15 that is in a mechanical motion state as the first transfer operation instruction information.

It suffices that the first transfer operation instruction information generation section (current press motion state detector 28) detect the current slide position Ppa either directly or indirectly from the slide 15. For example, the first transfer operation instruction information generation section may include a photoelectric displacement detection section that photoelectrically detects the displacement of the slide.

When controlling only the transfer operation of the servo transfer device 50, the target value (current slide position Ppa) may be input directly to the transfer controller 67 to control the transfer operation. In this case, the current transfer state detector 68 is configured to output the current transfer position Pta that corresponds to the current slide position Ppa, and the current transfer position Pta is used as the feedback signal.

However, since the pendulum motion angle is converted into the virtual rotation angle, the target value Z (Sts) is input to the transfer controller 67, and the current transfer position Pta input from the current transfer state detector 68 is used as the feedback signal.

The first virtual rotation angle generation section 31 that generates and outputs the first virtual rotation angle Y converts the first transfer operation instruction information (current slide position information Ppa) input to the first virtual rotation angle generation section 31 into the rotation angle information θpa that corresponds to the first transfer operation instruction information. The second embodiment differs from the first embodiment as to the above function.

The configurations and the functions of the second virtual rotation angle generation section 38 that generates and outputs the second virtual rotation angle Y', the virtual rotation time calculation section (intra-inversion region motion determination section) 34, the transfer operation instruction information switch/output section 40, and the switch smoothing section 47 are the same as those of the first embodiment.

According to the second embodiment, the reliability of the first transfer operation instruction information and the second transfer operation instruction information can be improved, and the synchronized operation of the servo transfer device 50 and the servo press 10 can be further stabilized in the same manner as in the first embodiment. The second embodiment can be easily applied to a servo press (system) that utilizes the slide position instruction information Sps and the current slide position information Spa as compared with the first embodiment.

Specifically, it is possible to provide a system in which position signals are used as the drive control signal of the servo press 10 and the servo transfer device 50, and the virtual rotation angle method is used for various settings and the like.

Although only some embodiments of the invention have been described in detail above, those skilled in the art would readily appreciate that many modifications are possible in the embodiments without materially departing from the novel teachings and advantages of the invention. Accordingly, such modifications are intended to be included within the scope of the invention.

What is claimed is:

1. A servo press system comprising:

a servo press configured to move a slide upward and downward by rotating a crank shaft; and a servo transfer device configured to implement an advance motion to carry a pressed workpiece out of the servo press, and implement a return motion to hold another pressed workpiece after the advance operation, wherein the servo press is configured to implement a press operation using a pendulum motion of the crank shaft, a rotational direction of the crank shaft being inverted within a motion direction inversion region while the servo transfer device implements the advance operation, the servo transfer device is configured to receive first transfer operation instruction information that is generated depending on a rotation angle of the crank shaft, and second transfer operation instruction information that is generated independently of the rotation angle of the crank shaft, the servo press system is configured to determine whether or not the rotation angle of the crank shaft is within the motion direction inversion region, and the servo transfer device is configured to implement the return motion by utilizing the first transfer operation instruction information when it has been determined that the rotation angle of the crank shaft is not within the motion direction inversion region, and implement the advance motion by utilizing the second transfer operation instruction information when it has been determined that the rotation angle of the crank shaft is within the motion direction inversion region.

2. A servo press system comprising:

a servo press configured to move a slide upward and downward by rotating a crank shaft; and a servo transfer device configured to implement an advance motion to carry a pressed workpiece out of the servo press and implement a return motion to hold another pressed workpiece after the advance operation, the servo press being configured to implement a press operation using a pendulum motion of the crank shaft based on press operation instruction information, a motion direction of the slide switching from upward to downward within a preset motion direction inversion region while the servo transfer device implements the advance operation, the servo press system further comprising:

a first transfer operation instruction information generation section configured to generate first transfer operation instruction information depending on a position of the slide in a vertical direction;

a second transfer operation instruction information generation section configured to generate second transfer operation instruction information independently of the position of the slide;

an intra-inversion region motion determination section configured to determine whether or not the position of the slide falls within the preset motion direction inversion region; and a transfer operation instruction information switch/output section configured to output the first transfer operation instruction information to the servo transfer device so that the servo transfer device implements the return motion when it has been determined that the position of the slide does not fall within the motion direction inversion region, and output the second transfer operation instruction information to the servo transfer device so that the servo transfer device implements the advance motion when it has been determined that the position of the slide falls within the motion direction inversion region. continuity of the advance and return motion of the servo transfer device being ensured regardless of whether or not the position of the slide falls within the motion direction inversion region.

3. The servo press system according to claim 1, wherein the second transfer operation instruction information is a created rotation angle based on a press speed of the servo press.

4. The servo press system according to claim 3, wherein the rotation angle is converted into a first virtual rotation angle, the created rotation angle is converted into a second virtual rotation angle, and the first virtual rotation angle and the second virtual rotation angle are selectively output.

5. The servo press system according to claim 1, wherein smoothed transfer operation instruction information is generated by combining the first transfer operation instruction information and the second transfer operation instruction information while a ratio of the first transfer operation instruction information is changed to the second transfer operation instruction information during a switch operation between the first transfer operation instruction information and the second transfer operation instruction information, and the smoothed transfer operation instruction information is output to the servo transfer device during the switch operation.

6. The servo press system according to claim 2, wherein the second transfer operation instruction information generation section generates created rotation angle information that is created based on press speed information, and has continuity as the second transfer operation instruction information.

7. The servo press system according to claim 6, further comprising a switch smoothing section configured to generate smoothed transfer operation instruction information by combining the first transfer operation instruction information and the second transfer operation instruction information while changing a ratio of the first transfer operation instruction information to the second transfer operation instruction information during a switch operation between the first transfer operation instruction information and the second transfer operation instruction information, wherein the transfer operation instruction information switch/output section is configured to output the smoothed transfer operation instruction information generated by the switch smoothing section to the servo transfer device during the switch operation.

8. A method of controlling a transfer motion of a servo transfer device, the servo transfer device transferring a workpiece to a servo press that moves a slide upward and downward by rotating a crank shaft using a pendulum motion, the method comprising:

generating a first transfer operation instruction information depending on a mechanical motion state of a press element of the servo press;

generating a second transfer operation transfer operation instruction information independently of the mechanical motion state of the press element;

determining whether or not a current motion state of the press element to be determined based on a rotation angle of the crank shaft during the pendulum motion is within a motion direction inversion region; and implementing the transfer motion of the servo transfer device by utilizing the first transfer operation instruction information when it has been determined that the current motion state of the press element is not within the motion direction inversion region, and implementing the transfer motion of the servo transfer device by utilizing the second transfer operation instruction information when it has been determined that the current motion state of the press element is within the motion direction inversion region.

9. The method according to claim 8, wherein the first transfer operation instruction information is generated based on a current rotation angle of the crank shaft as the mechanical motion state of the press element, and the second transfer operation instruction information is generated based on a created rotation angle depending on a press speed of the servo press.

10. The method according to claim 9, wherein the current rotation angle is converted into a first virtual rotation angle, the created rotation angle is converted into a second virtual rotation angle, and one of the first virtual rotation angle and the second virtual rotation angle is selectively output.

11. The method according to claim 8, wherein the first transfer operation instruction information is generated based on a current position of the slide in a vertical direction as the mechanical motion state of the press element, and the second transfer operation instruction information is generated based on the a created rotation angle depending on a press speed of the servo press.

12. The method according to claim 8, further comprising generating a smoothed transfer operation instruction information by combining the first transfer operation instruction information and the second transfer operation instruction information while changing a ratio of the first transfer operation instruction information to the second transfer operation instruction information during a switch operation between the first transfer operation instruction information and the second transfer operation instruction information and then outputting the smoothed transfer operation instruction information to the servo transfer device during the switch operation.

* * * * *